US005310012A

United States Patent [19]

Cendre et al.

[11] Patent Number: 5,310,012

[45] Date of Patent: May 10, 1994

[54] ACTUATING DEVICE ASSOCIATED WITH A DRILL STRING AND COMPRISING A HYDROSTATIC DRILLING FLUID CIRCUIT, ACTUATION METHOD AND APPLICATION THEREOF

[75] Inventors: André Cendre, Cosne sur Loire; Jean-Baptiste Fay, Paris; Benoit Amaudric du Chaffaut, Voisins le Bretonneux, all of France

[73] Assignee: Institut Francais du Petrole, Rueil Malmaison Cedex, France

[21] Appl. No.: 914,550

[22] Filed: Jul. 16, 1992

[51] Int. Cl.[5] ..... F21B 7/06; F21B 17/10

[52] U.S. Cl. ..... 175/38; 175/269; 175/325.1

[58] Field of Search ..... 175/38, 99, 106, 267, 175/269, 73, 76, 325.1; 166/212

[56] References Cited

U.S. PATENT DOCUMENTS

| | | | |
|---|---|---|---|
| 1,607,662 | 11/1926 | Boynton | 175/228 |
| 2,935,615 | 5/1960 | True | 250/269 |
| 3,780,809 | 12/1973 | Ayers, Jr. | 166/314 |
| 3,788,136 | 1/1974 | Park | 73/151 |
| 4,821,817 | 4/1989 | Cendre et al. | 175/269 |
| 4,951,760 | 8/1990 | Cendre et al. | 175/269 |

FOREIGN PATENT DOCUMENTS

| | | | |
|---|---|---|---|
| 0095134 | 11/1983 | European Pat. Off. . | |
| 231592 | 8/1987 | European Pat. Off. | 175/325.1 |
| 0376811 | 7/1990 | European Pat. Off. . | |
| 0377378 | 7/1990 | European Pat. Off. . | |
| 0409446A1 | 1/1991 | European Pat. Off. . | |
| WO91/00410 | 1/1991 | World Int. Prop. O. . | |

*Primary Examiner*—David J. Bagnell

*Attorney, Agent, or Firm*—Antonelli, Terry, Stout & Kraus

[57] ABSTRACT

The present invention is a device for the remote actuation of equipment (3) associated with a drill string (1) through a hydraulic displacement mechanism (10;53,58) co-operating with a distributor (7;25,26,27;47) associated with the drilling fluid. The displacement mechanism directly converts the hydraulic energy of the drilling fluid into actuating mechanical energy with the co-operation of no other fluid than the drilling fluid. The invention further relates to an actuating method using the device and has an application of directional drilling in the petroleum field.

11 Claims, 5 Drawing Sheets

ACTUATING DEVICE ASSOCIATED WITH A DRILL STRING AND COMPRISING A HYDROSTATIC DRILLING FLUID CIRCUIT, ACTUATION METHOD AND APPLICATION THEREOF

BACKGROUND OF THE INVENTION

The present invention relates to a device for actuating an equipment, associated with a drill string lowered in a well, and in which a drilling fluid whose basic function is to provide all the conventional drilling functions circulates. The actuating device according to the invention uses directly the hydraulic energy of the pressure of the circulating drilling fluid for actuating the equipment.

In the oil drilling field, it is often necessary to actuate equipment or tools incorporated in a drill string lowered in a wellbore. This may notably be the case for carrying out controlled directional drillings, exploratory measuring or testing operations or various operations for fitting up production wells.

The prior art mentions several well-known methods for actuating bottomhole equipment. They may consist in pumping tools into the pipe which, once they have reached the level of the equipment, activate it. Instead of pumping, a ball or an equivalent may be dropped into the drill string. These conventional methods present notably the drawback of sealing totally or, at best, temporarily the inner channel of the string, and therefore of requiring a more or less long pumping stop. Now, in drilling, it is always very dangerous not to keep the drilling fluid circulating. In fact, when the upward circulation of the fluid in the well-string annulus is too low, or even zero, there are risks of destabilization of the walls. Moreover, the cuttings being no longer taken up to the surface, they tend to settle and are likely to jam the string.

For all these reasons, technical development turned towards the use of other types of actuation. The action of weight on the tool, of the rotating speed or a combination of both may be used. But, in this case, constructions are very complex and little reliable for checking the control of these drilling parameters.

Patent EP-251,543-A for example is well-known, in which the actuation of a variable geometry stabilizer is achieved by weight on the tool. But the actuating system requires the action of an axial force up to a critical value with no positive locking in a determined position. The user is sometimes faced with error risks concerning knowledge of the position of the equipment. Besides, the weight on the tool is a parameter linked to the drill bit and has a direct influence on the drilling performance, so users do not wish to be limited in the use of this force for anything else than drilling progress.

The device of the present invention does not interfere at any time with the drilling parameters, be they hydraulic or mechanical.

Patent application EP-376,811 mentions a known actuating device comprising a needle-choke system using the hydrodynamic action of the drilling fluid circulation. This document describes the use of a flow rate increase for generating a pressure difference between upstream and downstream from the device sufficiently high for obtaining the actuation. It is obvious that, in this document, the pressure drops downstream from the device reduce the activation force.

On the contrary, in the present invention, all the pressure drops in the string downstream from the device are active for the actuation. This represents a definite advantage since these pressure drops always have sizeable values considering the indispensable presence of bits restricting the passageway, notably a drill bit. The necessary level of activation energy may thus be obtained more easily while remaining in normal operating conditions, which practically suppresses all the interferences with the wellbore surroundings.

In the prior art, which may be illustrated by patent application EP-376,811 cited above, inner mechanisms, notably activation, indexing and locking mechanisms, impose a specific lubrication of the parts. They must therefore be tight in relation to the presence of a fluid under pressure such as the drilling fluid. All these constraints are suppressed by the invention which uses directly the drilling fluid without any other buffer or intermediate fluid.

SUMMARY OF THE INVENTION

The present invention thus relates to a device for actuating equipment, associated with a drill string lowered in a well, and in which a drilling fluid circulates, said circulation generating a positive differential pressure DP between the inner space and the outer space of said string. Said device comprises distribution means comprising at least two ports, one of the ports being connected through a pipe to displacement means, the other port being connected through a pipe to said inner space. Said distribution means are adapted for controlling the communication of said drilling fluid under pressure between the inner space of the string and an intake port for said displacement means. The latter further comprise another exhaust port connected through a pipe to said outer space.

Said displacement means are adapted for being activated by converting the hydraulic energy resulting from the differential pressure DP of said drilling fluid between said two intake and exhaust ports into a mechanical activation energy. Conversion is achieved directly with the co-operation of no other fluid than said drilling fluid, and said distribution means comprise a portion in which the pipe connecting said distribution means to said intake port of said displacement means is closed.

Said distribution means of the device according to the invention may comprise two inlet ports and two outlet ports communicating two by two. Said distribution means may be adapted for reversing communications. The inlet ports are then connected through pipes, one to the inner space, the other to the outer space and the outlet ports are then connected through pipes, one to the intake port of said displacement means, the other to the exhaust port, the distribution means being also adapted for closing the two outlet ports.

The distribution means may comprise a two-position gate valve with two ports, and said displacement means may comprise return means. In a first position, said gate valve can open the communication of said drilling fluid between the inner space of the string and said displacement means, said displacement means being activated when said mechanical activation energy is higher than the energy developed by said return means. In a second position, said gate valve may shut off the pipe communicating said drilling fluid between the inner space and said displacement means.

The displacement means may be of the longitudinal jack type whose two chambers, notably separated by a sealed piston, are filled by said drilling fluid. Said piston is notably subjected to said differential pressure DP.

The distribution means may be remote controlled from the surface.

The displacement means may comprise several longitudinal jacks arranged in series and a translating shaft co-operating with a variable geometry stabilizer.

The displacement means of the present invention may comprise a needle-choke system restricting the passage of the drilling fluid in said inner space at the end of the activation stage of said means.

The invention also provides a method for using the device comprising the following stages:

setting, notably by pumping at the surface, the value of the differential pressure DP to a determined value, controlling said distribution means so as to allow the circulation of said drilling fluid under pressure between the inner space and said displacement means, actuating the equipment by activating said displacement means when said mechanical energy is higher than the energy developed by the return means of said displacement means, controlling said distribution means so as to shut off communication between the inner space and said displacement means and to lock said displacement means in position, controlling said distribution means so as to open communication between the inner space and said displacement means and decreasing the differential pressure DP, notably by adjusting the pumping, until the energy developped by said return means is higher than said mechanical energy.

The present invention also relates to the application of the device and of the previous method to directional drilling.

The basic idea of the invention is to use directly the hydraulic energy available in a pipe in which a fluid under pressure circulates. In fact, the actuating device of the invention may be compared to a shunted hydrostatic circuit between the inner space and the outer space of the string. Part of the hydraulic energy is sent towards the displacement means. A distribution means control the admittance or not of this energy towards the displacement means having the function of a receiver. In order to simplify the pattern of the various elements, to limit maintenance while increasing the reliability of the device, the hydraulic fluid used is directly the drilling fluid present in the inner channel of the string. In this invention, the distribution means, the displacement means and the equipment are adapted for working with any type of drilling fluid.

One advantage of the invention is to use the differential pressure prevailing at the level of the device between the inside pressure and the outside pressure so as to obtain the necessary actuating energy. It should be noted that the useful pressure in the inner space is generated by the pressure drops downstream from the device. Consequently, in this invention, it is generally not necessary to shut off the circulation channel to be able to activate. Contrarily to document EP-376,811 cited above, in which the active pressure is the differential pressure inside the channel between upstream and downstream from the device, and the more pressure drops there are downstream, the less active the pressure is.

BRIEF DESCRIPTION OF THE DRAWINGS

Other features and advantages of the present invention will be clear from reading the description hereafter given by way of non limitative example, with reference to the accompanying drawings in which.

DESCRIPTION OF THE PREFERRED EMBODIMENTS

Figure 1:
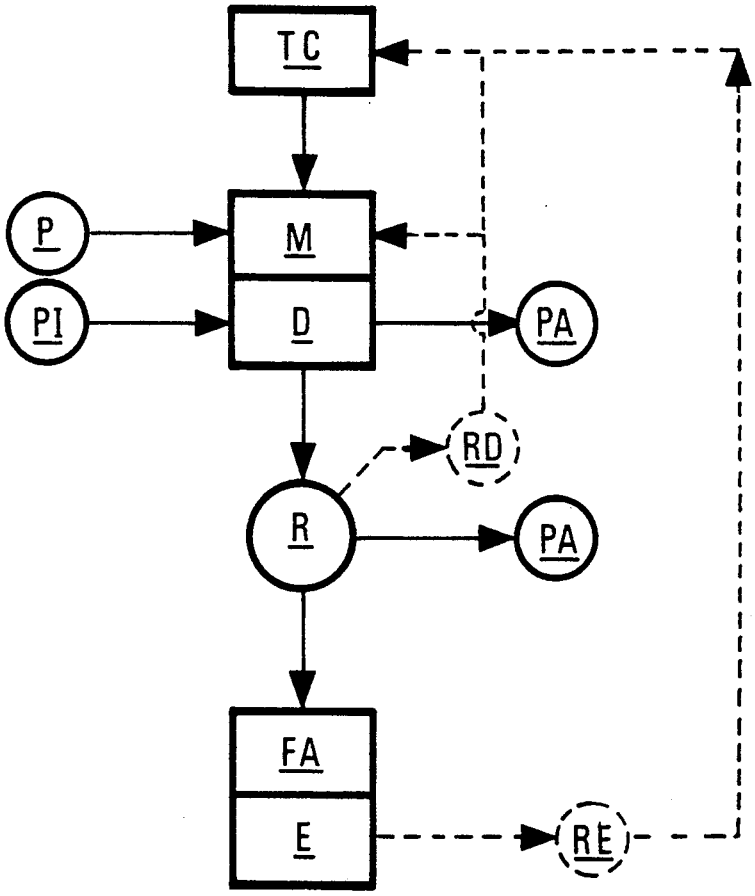
FIG. 1 shows a block diagram of the device.

FIG. 1 shows a block diagram of said device in which:

PI and PA are respectively the pressures in the inner space and in the outer space of the drill string, TC are control or remote control means;

D are distribution means operated by a motor means M;

P is the power necessary to the motor means;

R are displacement means or receiver;

FA is a mechanical action;

E is the equipment to be actuated;

dotted lines RD and RE respectively reproduce the state of the displacement means and of the equipment.

This diagram shows the various functional connections that link together the parts constituting the device. Control TC is connected to the surface through the hydraulic transmission of information sequences as disclosed in document EP-A-377,376. Other transmission types, notably through electric cable, optical fibers, pressure waves or electromagnetic waves may be used without departing from the scope of this invention. Part TC sends signals towards motor means M. The motorization power P is supplied by a set of electric accumulators. If the transmission mode is a cable transmission, the energy may transit by means of this cable. A power generator working notably from the circulation of the drilling fluid may also be integrated to the string.

M operates distribution means D. The latter controls the hydraulic energy available between PI and PA and supplies or not said energy towards the displacement means or the receiver. R is notably of the single-acting jack type with a return spring or a double-acting jack. One chamber of the jack receives directly the drilling fluid at the pressure PI and the other chamber contains the same fluid but at the pressure PA. The displacement of the piston and the thrust force corresponding to the action of the pressures provide the activation energy of mechanical action FA. The latter actuates equipment E.

Without departing from the scope of this invention, receiver R may be of a type other than a longitudinal jack, notably a rotary jack, a rotary engine or a turbine. In these cases, mechanical action FA may have notably the form of the rotation of a couple of forces.

Dotted line RD represents the return signal sent by sensors locating the position of the displacement means. This signal, which may transit towards the surface, allows checking the achievement of the command at the level of the receiver.

Dotted line RE represents a signal indicating the actuation of equipment E. This signal is notably a pressure increase in the inner space of the string, but the signal may be of another nature and transit through other transmission means without departing from the scope of this invention.

Figure 2:
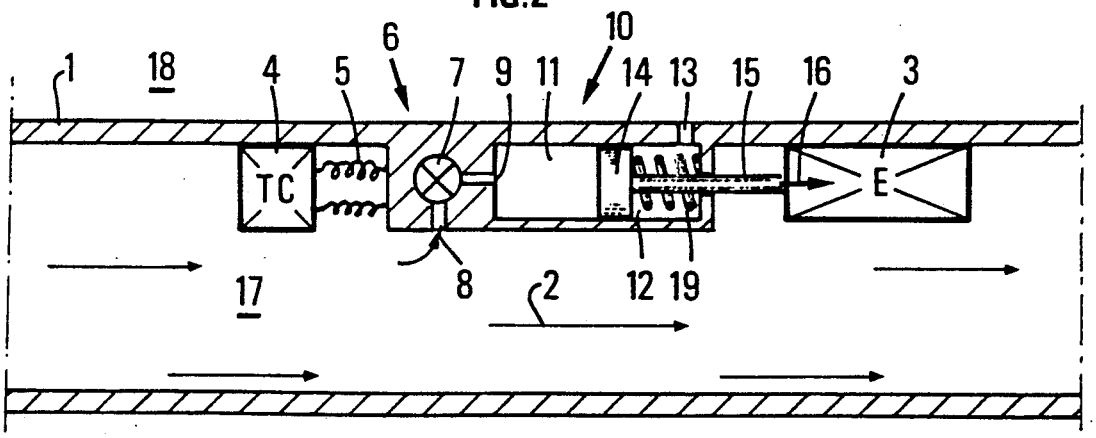
FIG. 2 shows a flow sheet of the device.

FIG. 2 shows the principle of the relative lay-out of the various parts constituting the invention.

Equipment 3 is associated with a pipe 1 which is in a drill string, in which a drilling fluid shown by arrows 2 circulates. Control means TC 4, distribution means 6 and displacement means 10, such as a jack, are integrated in the drill string. Control means 4 are connected to distribution means 6 by conductors 5.

Distribution means 6 comprise a gate valve 7 controlling the circulation of the drilling fluid through a pipe opening at 8 in the inner space 17 of pipe 1, and at 9 in a chamber 11 of displacement means 10. A sealed piston 14 separates chamber 12 from chamber 11. Chamber 12 communicates with space 18 outside pipe 1 through the pipe opening in 13.

The mechanical connection between displacement means 10 and equipment 3 to be actuated comprises a shaft 15 and return means 19. Arrow 16 shows an actuating force.

Figure 3A:
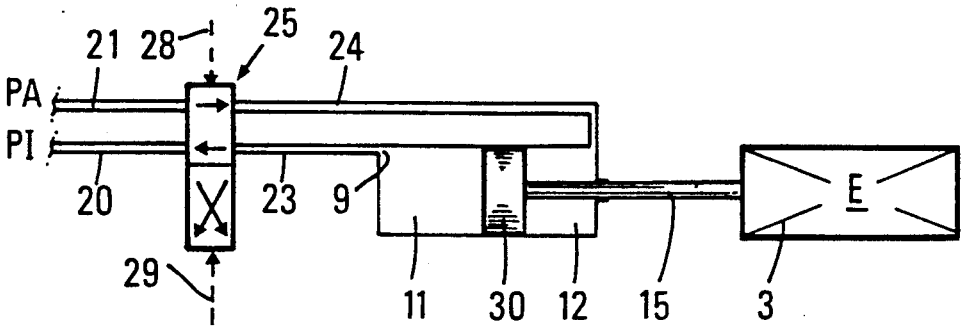
FIGS. 3A, 3B and 3C are hydrostatic diagrams showing three types of circuits allowing the embodiment of the device.
Figure 3B:
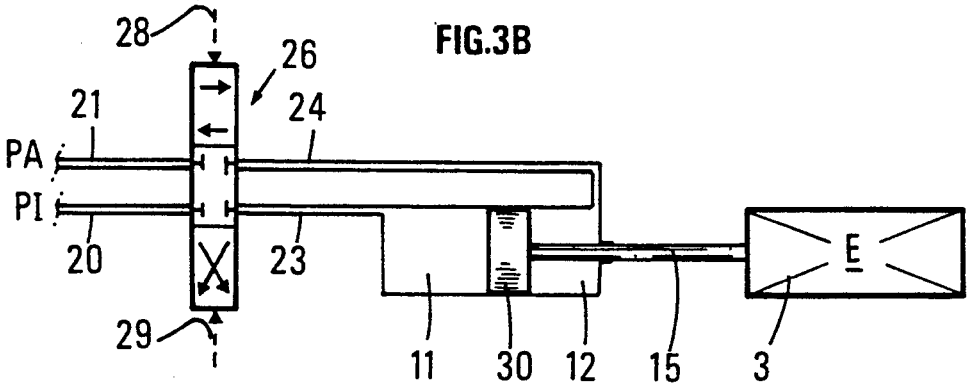

Without departing from the scope of this invention, communication through the pipe opening in 13 may also be controlled by the distribution means as shown in the circuit diagrams of FIG. 3A and FIG. 3B.

FIG. 3A shows a hydrostatic circuit integrated in said device. The distribution means comprise a four-way distributor 25 with two positions. This type of distributor, well-known in industry, may have multiple technical embodiments, notably a slide valve, a rotary distributor or a pilot-controlled check valve. The control signals coming from TC 4 are shown by lines 28 and 29.

An inlet pipe 21 is connected with the outer space PA. Pipe 20 is connected with the inner space PI.

An outlet pipe 23 is connected to the intake port of receiver 30. The exhaust port thereof is connected through a pipe 24 to the other outlet of distributor 25. The mechanical connection or shaft 15 co-operates with the equipment 3 to be actuated.

This circuit schematically represents an inversion function. In one position of the distributor, the drilling fluid under pressure coming from PI is run towards 9, the exhaust is then run towards PA through pipes 24 and 21.

In the second position, PI communicates with the exhaust through pipe 24 and intake 9 is then connected to PA through 23 and 21.

In the case illustrated by FIG. 3A where the receiver is a double-acting jack, this circuit allows the forward or the backward motion of said jack to be controlled.

FIG. 3B shows an improvement in the previous circuit insofar as distributor 26 is a four-way distributor with three positions. The additional third position being that in which pipes 20, 21, 23 and 24 are shut off. In this position, the displacement of the jack is blocked in all directions. In fact, considering that the drilling fluid contained in chambers 11 and 12 and in pipes 23 and 24 is practically incompressible and that there are substantially no leaks, the jack cannot move.

Figure 3C:
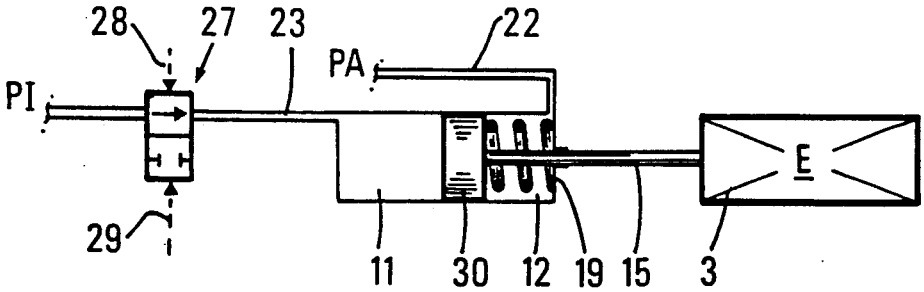

FIG. 3C shows a simplified hydrostatic circuit where jack 30 is a single-acting jack with a return spring 19 or an equivalent, a two-way distributor 27 with two positions, the exhaust of the jack being connected to PA through channel 22 directly, without any control through the distributor.

In one position of the distributor, PI communicates with the intake of the jack, in the other position the distributor shuts off pipe 23 and allows the displacement means or jack to be immobilized according to the same principle as in FIG. 3B.

It should be noted that these three types of circuits are adapted so that the carrier fluid is a drilling fluid. To that effect, it will notably be necessary to modify the dimensions of the pipes, the technology of the seals and the selection of the materials used according to the nature of the fluid, notably with respect to corrosion.

These circuits are also adapted for working with other receivers than longitudinal jacks.

The actuating principle of the device according to the invention allows controlled displacements and thus multiple actuations of the equipment. In fact, this advantage may be illustrated in a non limitative way by taking hereafter a jack as the receiver. The device allows the volume of fluid admitted into chamber 11 to be controlled, and knowing the displacement of the jack, notably through sensors, makes it possible to obtain a specific adjustment of the actuation of the equipment after the displacement of the jack.

Without departing from the scope of this invention, the displacement of the jack and thus of the equipment may also be pilot operated by means of position sensors and of the servocontrol electronics contained in the control system.

Of course, it will always be possible to operate in a more simplified way between the two extreme positions of the longitudinal jack.

The device may be equipped with a positive locking on the positioning of the equipment. This locking, not shown, may be controlled by the same control means TC.

FIGS. 4A, 4B, 4C and 4D show four stages of the most important elements of a drilling equipment actuated by the device of the invention. This equipment is a variable diameter stabilizer whose variable geometry is obtained through the activation of the actuating device of the present invention.

The equipment consists of a cylindric body 40 comprising at each end a conventional thread 41 (only the lower connection is shown). These threads allow this equipment to be integrated in a drill string as is usually done in the trade.

Figure 4A:
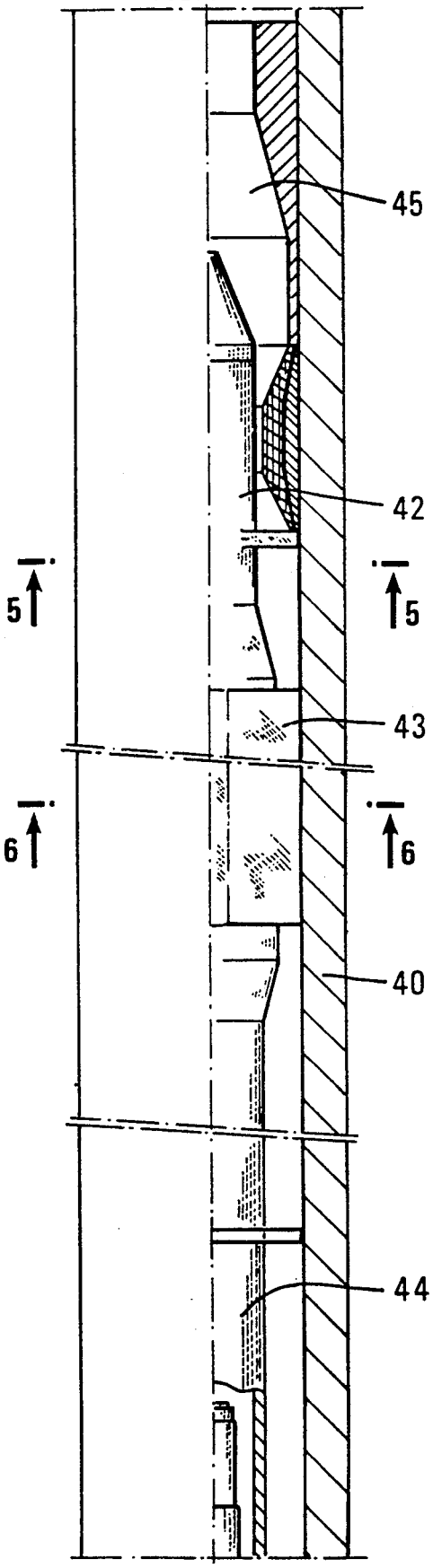
FIGS. 4A, 4B, 4C and 4D show a preferred embodiment of the device according to the present invention.
Figure 5:
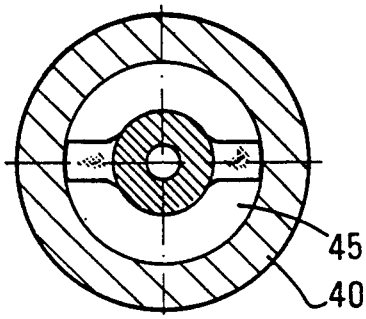
FIGS. 5, 6, 7 and 8 are cross-sections at various levels of the preferred embodiment.
Figure 6:
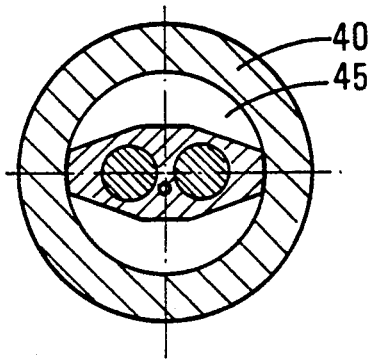

FIG. 4A shows the upper stage of said equipment where the remote control means are located. These means comprise a mechanical assembly 42, batteries 43 or electric accumulators and an electronic cartridge 44. This cartridge translates the commands transmitted through pressure signals from the surface. All these means located inside body 40 must be centered and fastened with mechanical means which let the drilling fluid circulate freely in an inner channel 45. This is illustrated by sections 5 and 6 in FIGS. 5 and 6.

Figure 4B:
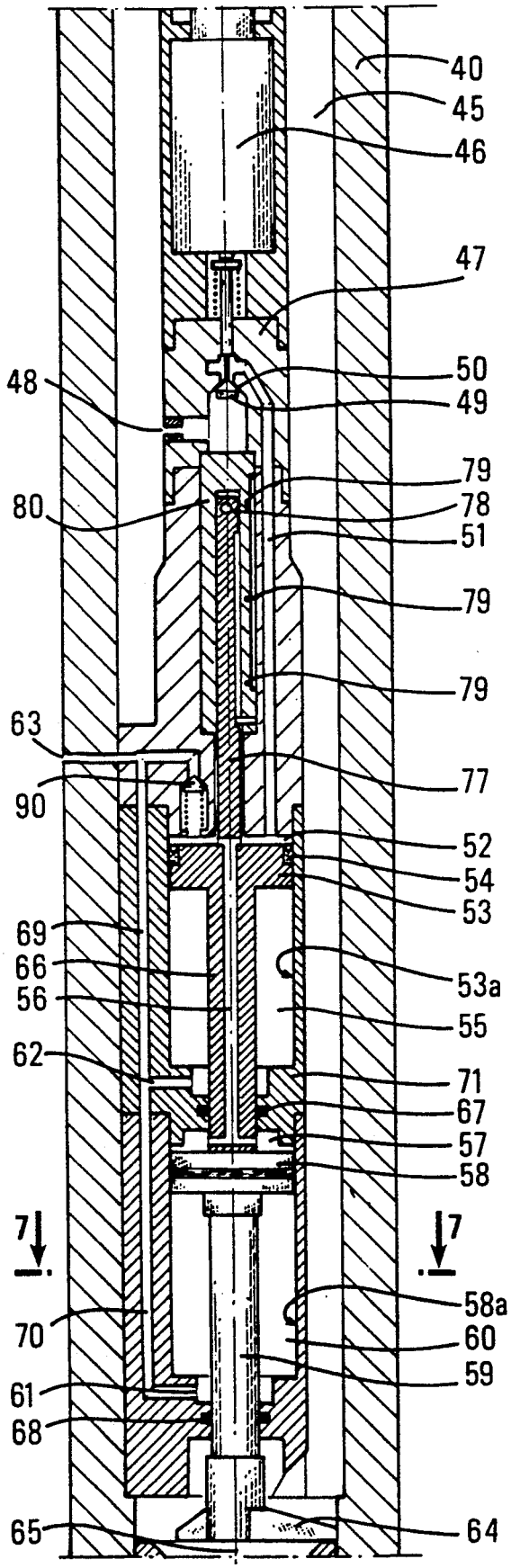

FIG. 4B shows the device for actuating the equipment. An electric motorization 46 controlled by electronic cartridge 44 and supplied by accumulators 43 adjusts the position of gate valve 47. The displacement of valve 49 in relation to the seat 50 thereof opens or shuts off this gate valve 47. When the valve is lifted with respect to the seat thereof, channel 51 communicates through port 48 with the inner space of the string, that is channel 45 where the drilling fluid circulates. The drilling fluid under pressure is then run through channel 51 to the volume of chamber 52. A piston 53 comprising joints 54 tightly separates chamber 52 from chamber 55. These chambers result from the co-operation of piston 53 and of a cylinder 53a. Joints 67 complete the seal of chamber 55 around the rod 66 of piston 53. The volume of chamber 55 communicates with the outer space by means of port 62 and of channel 69 which opens therein through port 63. A check valve 90 prevents any fluid leakage from chamber 52 towards the outside through port 63, but it allows an injection, notably for cleaning, through port 63 towards chamber 52, channel 51, gate valve 47 and port 48. This operation can only be achieved when the device is at the surface.

Rod 66 is mechanically connected to another piston 58 with a stroke identical to the first one. Chamber 57 communicates with chamber 52 through a pipe 56 pierced in rod 66. The volume of chamber 60 also communicates with the outside through port 61 and channel 70 which joins channel 69. Seal gaskets 68 are arranged around the rod 59 of the second piston 58.

More than two pistons may be assembled in series in accordance with the previous lay-out without departing from the scope of this invention. It is the same if the displacement means amount to a single piston when the actuating force developped thereby is sufficient.

Figure 7:
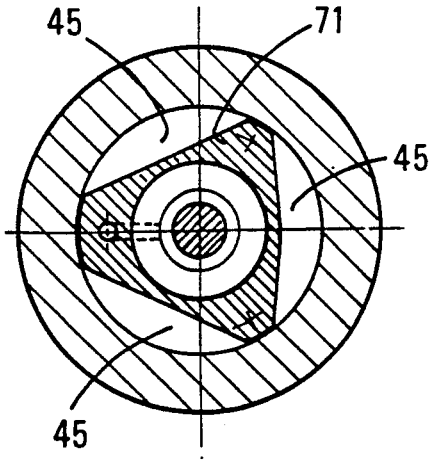

The body 71 of the double jacks, in which the liners 53a and 58a of pistons 53 and 58 have been machined, has an outer shape adapted for being placed in the inside diameter of body 40 and for letting a sufficient section of flow 45 for the fluid. FIG. 7 shows the section of flow of the fluid at the level of the body 71 of the double jack.

Rod 59 is connected to the actuating shaft through an assembly 64.

Piston 53 comprises an extension rod 77. This rod has a magnet 78 at the end thereof. Three supple blade switches 79 have been arranged in the receptacle 80 of extension rod 77.

Figure 4C:
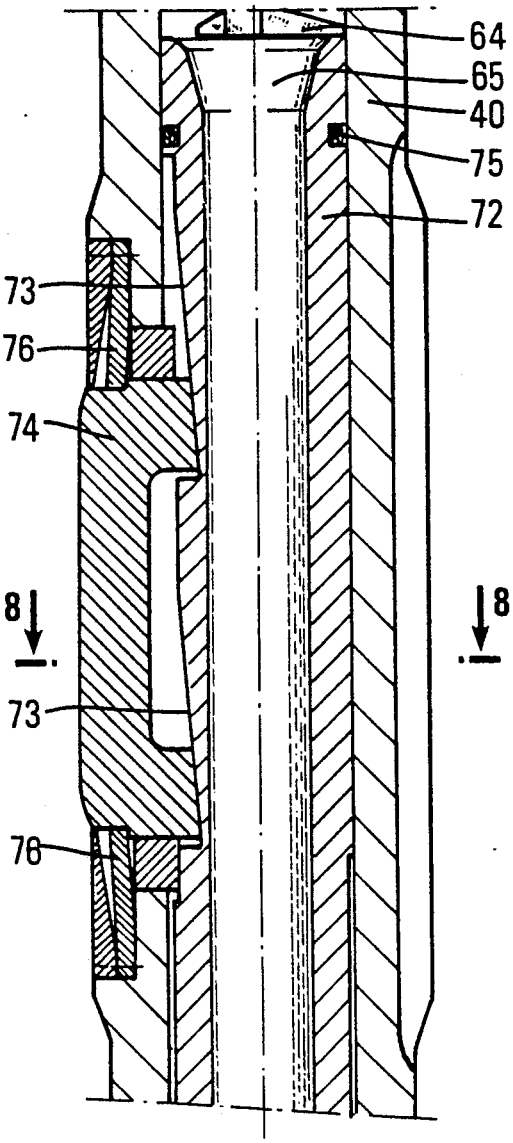

FIG. 4C shows the equipment actuated by the double jack. The shaft 72 is crossed by a channel 65 allowing the circulation of the drilling fluid.

Shaft 72 has on the outer surface thereof flat surfaces 73 inclined with respect to the longitudinal axis thereof and forming ramps. Stabilizer blades 74 rest against these inclined ramps 73. Springs 76 return blades 74 in a centripetal way. Joints 75 complete the seal of shaft 72 which co-operates with the inner wall of body 40.

Figure 8:
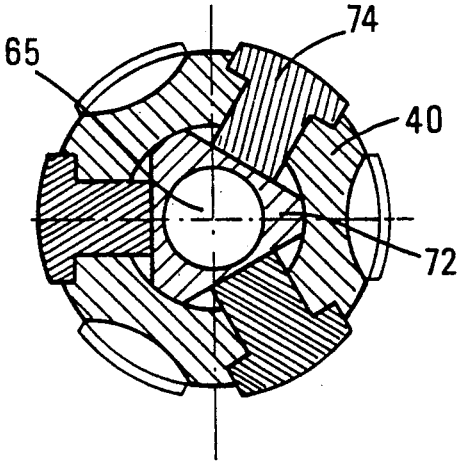

FIG. 8 shows a cross-section 8 of the variable geometry stabilizer where three blades 74 are arranged at angles of 120° on the circumference of body 40. Other layouts or a different number of blades may be used without departing from the scope of this invention.

Figure 4D:
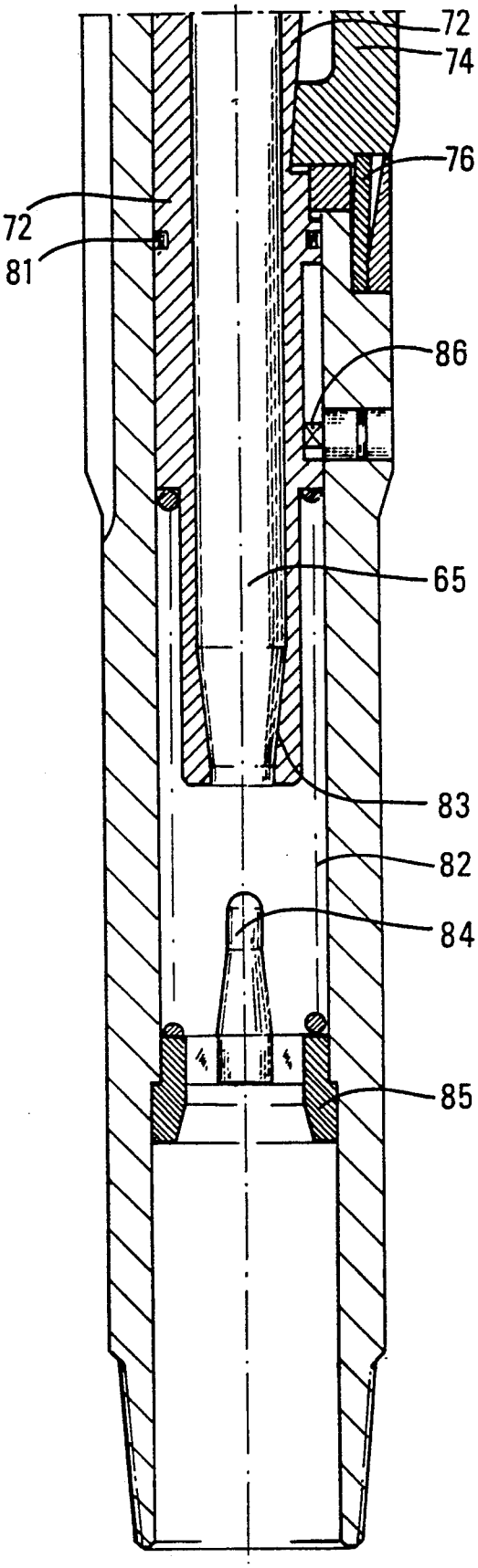

FIG. 4D shows the lower part of the equipment. Shaft 72 comprises another seal gasket 81. A return spring 82 rests on one side against a support 85 integral with body 40 and on the other side against the end of shaft 72.

The section of the inner channel 65 of shaft 72 is reduced at the lower end 83 thereof so as to co-operate with needle 84 axially integral with body 40.

A key 86 prevents the rotation of shaft 72 on the longitudinal axis thereof with respect to body 40.

The following successive stages should be considered for describing clearly the operating mode of this equipment actuated by the device of the present invention:

the order to open gate valve 47 has been given, which results in balancing the pressures between the inside of the string and chambers 52 and 57;

the circulation of the drilling fluid in channel 45 is stopped or has already been stopped, the differential pressure between the inside and the outside of the string is substantially zero;

the force of return spring 82 is then preponderant as there is no stress on pistons 53 and 58 because of the absence of differential pressure;

the shaft is in higher position and blades 74 are retracted in body 40;

if the circulation of the drilling fluid is started again, the inside pressure at the level of the device will increase in relation to the outside pressure. The pressure acting on pistons 53 and 58 substantially depends on the pressure drops generated on the path of the drilling fluid between the inside 45 and more precisely at the level of port 48 and the outside pressure, more precisely at the level of port 63;

when the pressure in chambers 52 and 57 of the jacks develops a force higher than the return forces, the jacks slide while pushing shaft 72 downwards;

at the same time, the blades of the stabilizer are pushed radially towards the outside;

rod 77 follows the displacement of the jacks and magnet 78 lies, at the end of the travel thereof, opposite a supple blade switch 79, the latter is activated and acts as an end-of-travel contactor. The signal provided by the contactor is used for shutting off gate valve 47. According to the remote control modes, this signal may transit up to the surface and inform of the end of the actuation in a positive way, but in a more simplified way, this signal is only internally looped on electronic cartridge 44. The actuation information is then supplied by the pressure increase which can be measured at the surface. This increase results from the co-operation of choke 83 with needle 84 at the end of the displacement of shaft 72;

gate valve 47 being shut, a volume of drilling fluid under pressure has been trapped in the volumes of chambers 52 and 57 and in channel 51. Gate valve 47 isolating this volume from the outer space, the pressure range in the inner space can be changed through different pumping conditions without any change of state of the actuating means, that is the equipment. The gate valve is thus used as a means for immobilizing the equipment when the blades are out. The device may be equipped with a mechanical locking controlled through the electronic cartridge 44 of the remote control. This locking may have different forms known in the prior art, notably electromagnetically retractable hooks. Without departing from the scope of this invention, the position of the displacement means can be pilot-operated by means of supple blade switches 79. In fact, if there is a leak at gate valve 47, extension rod 77 moves with respect to the switch. The signal obtained can then control the opening of gate valve 47 so as to compensate the leak and to hold the displacement means in position;

to come back to a state identical to the original one, which may be called state of rest, giving the order to open gate valve 47 is sufficient, while adjusting, if need be, the pumping conditions so as to have a pressure difference DP either zero or low enough for spring 82 to push back shaft 72, the double jacks and rod 77. When magnet 78 activates upper position limit switch 79, the gate valve is automatically closed so as to insulate the actuating means from the inner pressure conditions.

It is advantageous, in this particular embodiment, to place at least a third blade switch 79 between the two end-of-travel extremes. The intermediate switch allows an intermediate position of the stabilizer blades. In fact, if the order given from the surface corresponds to the activation of the stabilizer at an intermediate diameter, when the means and rod 77 jointly move, the magnet, by activating the intermediate switch, immobilizes the assembly by shutting gate valve 47 when the jacks are halfway. The blades of the stabilizer will be partly out and the stabilizer will be set to an intermediate diameter. The locking or the servo-control means described above can provide this intermediate position.

It appears that this device allows as many actuating adjustments as different commands can be sent from the surface and translated at the level of the device. But each adjustment must have a specific position sensor.

We claim:

1. A device for actuating an equipment associated with a drill string lowered in a well, and in which a drilling fluid circulates, said circulation generating a positive differential pressure DP between the inner space and the outer space of said string wherein:

said device comprises distribution means comprising at least two ports, one of the ports being connected through a pipe to displacement means, the other port being connected through a pipe to said inner space;

said distribution means is adapted for controlling the communication of said drilling fluid under pressure between the inner space of the string and an inlet port for said displacement means;

said displacement means comprise an exhaust port connected through a pipe to said outer space;

said displacement means are adapted for being activated by converting the hydraulic energy resulting from the differential pressure DP of said drilling fluid between said inlet port and exhaust port into a mechanical activation energy and wherein the conversion is achieved directly with the co-operation of no other fluid than said drilling fluid; and wherein said distribution means comprise a position in which the pipe connecting said distribution means to said inlet port of said displacement means is closed.

2. A device as claimed in claim 1, wherein:

said distribution means comprise two inlet ports and two exhaust ports communicating two by two, said distribution means being adapted for reversing communications;

said inlet ports are connected through pipes, one to the inner space, the other one to the outer space;

said exhaust ports are connected through pipes, one to the inlet port of said displacement means, the other one to the exhaust port; and said distribution means are adapted for shutting off said two exhaust ports.

3. A device as claimed in claim 1, wherein:

said distribution means comprise a two-position gate valve with two ports;

said displacement means comprise return means; and wherein in a first position, said gate valve opens the communication of said drilling fluid between the inner space of the string and said displacement means, said displacement means being activates when said mechanical activation energy is higher than the energy developed by said return means; and in a second position, said gate valve shuts off the pipe communicating said drilling fluid between the inner space and said displacement means.

4. A device as claimed in claim 1, wherein:

said displacement means are of the longitudinal jack type having two chambers, separated by a sealed piston, are filled with said drilling fluid, said piston being subjected to said differential pressure DP.

5. A device as claimed in claim 4, wherein:

said displacement means comprise several longitudinal jacks arranged in series.

6. A device as claimed in claim 1, wherein:

said distribution means are remote controlled from the surface.

7. A device as claimed in claim 1, comprising:

at least three sensors for picking up the position of said displacement means, two of them indexing the extreme positions and the third one, an intermediate displacement.

8. A device as claimed in claim 1, wherein:

said displacement means comprise a translating shaft co-operating with a variable geometry stabilizer.

9. A device as claimed in claim 8, wherein:

said displacement means comprise a needle-choke system restricting the passage of the drilling fluid in said inner space at the end of an activation stage.

10. A method comprising:

setting, by pumping from the surface, the value of a differential pressure DP to a determined value;

controlling a distribution means so as to allow circulation of a drilling fluid under pressure between an inner space and a displacement means;

actuating an equipment by activating said displacement means when mechanical energy of the drilling fluid is higher than energy developed by a return means of said displacement means;

controlling said distribution means so as to shut off communication between the inner space and said displacement means and to lock said displacement means in position; and controlling said distribution means so as to open communication between the inner space and said displacement means, and decreasing the differential pressure DP, by adjusting pumping, until the energy developed by said return means is higher than said mechanical energy.

11. A method in accordance with claim 10 wherein; the equipment is used for directional drilling.

* * * * *